United States Patent [19]

Niimura et al.

[11] Patent Number: 4,624,907

[45] Date of Patent: Nov. 25, 1986

[54] ELECTROPHOTOGRAPHIC TONER CONTAINING METAL COMPLEX

[75] Inventors: Isao Niimura, Iwatsuki; Katsuichi Motohashi, Urawa; Hiroyoshi Yamaga, Fukaya; Noboru Akuzawa, Tokyo, all of Japan

[73] Assignee: Hodogaya Chemical Co., Ltd., Tokyo, Japan

[21] Appl. No.: 669,370

[22] Filed: Nov. 8, 1984

[51] Int. Cl.[4] ..... G03G 9/08; G03G 9/10

[52] U.S. Cl. ..... 430/106; 430/110; 534/693; 534/696; 534/721

[58] Field of Search ..... 430/106, 110; 534/693, 534/696, 721

[56] References Cited

U.S. PATENT DOCUMENTS

| | | | |
|---|---|---|---|
| 4,362,803 | 12/1982 | Miyakawa et al. | 430/106.6 X |
| 4,433,040 | 2/1984 | Niimara et al. | 430/109 |
| 4,562,136 | 12/1985 | Inoue et al. | 430/110 X |

FOREIGN PATENT DOCUMENTS

| | | | |
|---|---|---|---|
| 45-26478 | 9/1970 | Japan | 430/106 |
| 52-67331 | 6/1977 | Japan | 430/106 |
| 55-135854 | 10/1980 | Japan | 430/110 |
| 57-167033 | 10/1982 | Japan | 430/106 |
| 58-152256 | 9/1983 | Japan | 430/106 |
| 58-208750 | 12/1983 | Japan | 430/106 |
| 59-50449 | 3/1984 | Japan | 430/106 |

*Primary Examiner*—Roland E. Martin

*Attorney, Agent, or Firm*—Oblon, Fisher, Spivak, McClelland, & Maier

[57] ABSTRACT

An electrophotographic toner capable of being electrified negatively comprising:

(a) a binder resin; and (b) a charge-controlling and coloring agent comprising at least one 2:1 type metal complex of the formula (I):

where each of $X_1$ and $X_2$, which may be the same or different, is a hydrogen atom, a $C_1$–$C_5$ alkyl group, a $C_1$–$C_5$ alkoxy group, a nitro group or a halogen atom, each of m and m′ is an integer of 1 to 3, each of $R_1$ and $R_2$, which may be the same or different, is a hydrogen atom, a $C_1$–$C_5$ alkyl group, a $C_1$–$C_5$ alkoxy group, a halgen atom, a nitro group, a sulfonamide group, a methylsulfonyl group, an ethylsulfonyl group, an acetyl amino group or a benzoyl amino group, each of n and n′ is an integer of 1 to 3, $Y^{\oplus}$ is an ammonium ion, an aliphatic ammonium ion, an alicyclic ammonium ion or a heterocyclic ammonium ion, and M is a chromium atom, a cobalt atom or an iron atom.

4 Claims, No Drawings

ELECTROPHOTOGRAPHIC TONER CONTAINING METAL COMPLEX

The present invention relates to an electrophotographic toner, particularly, to a toner for developing electrostatic latent images in electrophotography, the toner being capable of being electrified negatively.

It is known that in electrophotography and electrostatic printing, electrostatic latent images which are electrified either positively or negatively on a photoconductive layer containing a photoconductive material such as selenium, zinc oxide, cadmium, cadmium sulfide, zinc sulfide, tellurium, anthracene, carbazol compounds or polyvinyl compounds, can be converted into visible images by developing the latent images with a toner. The latent images are produced by imagewisely exposing the surface of the photoconductive layer to actinic rays. The visible images are, if necessary, transferred to a surface of a substrate, such as paper, and, then, fixed thereon by means of heat or a solvent.

The particles of the toner comprise a binder consisting of a natural or synthetic resin and a finely divided coloring agent uniformly dispersed in the binder resin. The coloring agent comprises at least one member selected from dyes and pigments.

The toner is used alone or in combination with a solid carrier comprising finely divided glass or iron particles.

When the latent positive images are electrified negatively and negatively electrified positive images are developed with toner particles electrified positively, the resultant visible images are positive. However, when the latent positive images are electrified positively and the positively electrified positive images are developed with toner particles electrified negatively, the resultant visible images are negative.

Usually, conventional dyes and pigments are capable of being electrified positively. Even if the conventional dyes and pigments are capable of being electrified negatively, the quantity of electricity on the dyes or pigments is unsatisfactory.

Also, some types of dyes and pigments are unsatisfactorily compatible with the binder resin. Therefore, when the latent images electrified positively are developed with the toner particles containing conventional dyes or pigments, the resultant visible images are not clear and, sometimes, foggy.

Also, it is known that some types of metal-containing aromatic compound are effective as a charge-controlling agent. However, conventional metal-containing charge-controlling agents are unsatisfactory as the coloring agent.

For example, U.S. Pat. No. 4,206,064 discloses a negatively electrified toner for developing electrostatic images. The toner contains a charge-controlling agent comprising at least one member selected from metal complexes of salicylic acid and metal complexes of alkyl salicylic acid. However, the above-mentioned types of metal complexes are useless as a coloring agent, and exhibit as unsatisfactory compatibility with the binder resins.

An object of the present invention is to provide an electrophotographic toner containing a metal complex which is capable of being electrified negatively and is satisfactory not only as a coloring agent, but, also, as a charge-controlling agent.

Another object of the present invention is to provide an electrophotographic toner containing a metal complex which is capable of being electrified negatively and is highly compatible with a binder resin.

The electrophotographic toner of the present invention, by which the above-mentioned objects can be attained, comprises:

(a) a biner resin; and (b) a charge-controlling and coloring agent comprising at least one 2:1 type metal complex of the formula (I):

(I)

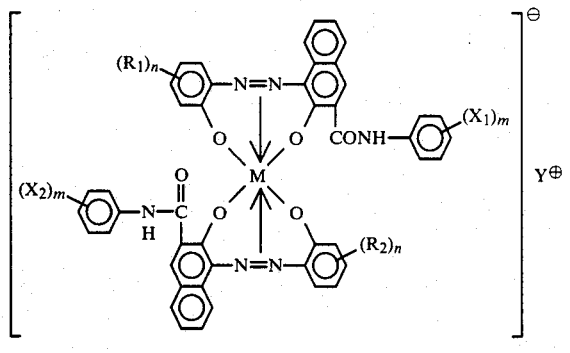

where each of $X_1$ and $X_2$, which may be the same or different, is a hydrogen atom, a $C_1$–$C_5$ alkyl group, a $C_1$–$C_5$ alkoxy group, a nitro group or a halogen atom, each of m and m′ is an integer of 1 to 3, each of $R_1$ and $R_2$, which may be the same or different, is a hydrogen atom, a $C_1$–$C_5$ alkyl group, a $C_1$–$C_5$ alkoxy group, a halogen atom, a nitro group, a sulfonamide group, a methylsulfonyl group, an ethylsulfonyl group, an acetyl amino group or a benzoyl amino group, each of n and n′ is an integer of 1 to 3, $Y^{\oplus}$ is an ammonium ion, an aliphatic ammonium ion, an alicyclic ammonium ion or a heterocyclic ammonium ion, and M is a chromium atom, a cobalt atom or an iron atom.

The above-mentioned metal complex is highly capable of being electrified negatively and exhibits a satisfactory compatibility with the binder resin.

The electrophotographic toner of the present invention comprises a binder resin and a specific charge-controlling and coloring agent.

The binder resin may consist of at least one member selected from the group consisting of homopolymers of styrene or substituted styrene such as polystyrene, poly-p-chlorostyrene, polyvinyltoluene and the like, styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylic acid copolymers, styrene-octyl acrylate copolymers, styrene-methyl methacrylate copolymers, styrene-ethyl methacrylate copolymers, styrene-butylmethacrylate copolymers, styrene-methyl-α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, and the like, polyvinyl chloride, polyvinyl acetate, polyethylene, polypropylene, silicone resins, polyesters, polyurethanes, polyamides, epoxy resins, polyvinyl butyral, rosin, modified rosins, terpene resins, phenolic resins, xylene resins, aliphatic or alicyclic hydrocarbon resins, aromatic series petroleum resins, chlorinated paraffins, paraffin waxes and the like.

The charge-controlling and coloring agent useful for the present invention is characterized by comprising at least one specific 2:1 type metal complex of the formula (I).

It is not completely clear why the metal complexes of the formula (I) can exhibit the remarkably high compatibility with the binder resin. However, it is assumed that, since the metal complexes of the formula (I) have a very small specific gravity and an enhanced softness, the metal complexes are easily divided into very fine particles in the binder resin matrix.

Also, it was found by the inventors of the present invention that the metal complexes of the formula (I) exhibit an excellent negative electrification property and can receive a large quantity of electrostatic negative charge.

The metal complexes of the formula (I) can be prepared by the following method:

(1) A 2-aminophenol compound of the formula (II):

(II)

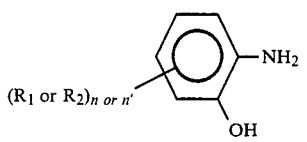

and a $\beta$-naphthol compound of the formula (III):

(III)

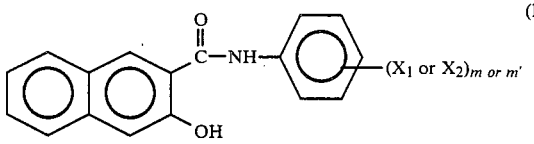

are subjected to a usual coupling procedure to prepare a monoazo compound of the formula (IV):

(IV)

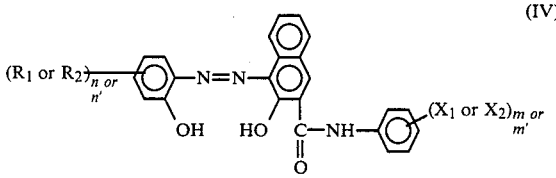

(2) The monoazo compound of the formula (IV) is converted into a metal complex of the formula (V) by a conventional metallization method using a chromium-, iron- or cobalt-imparting compound in an organic solvent at an elevated temperature.

(V)

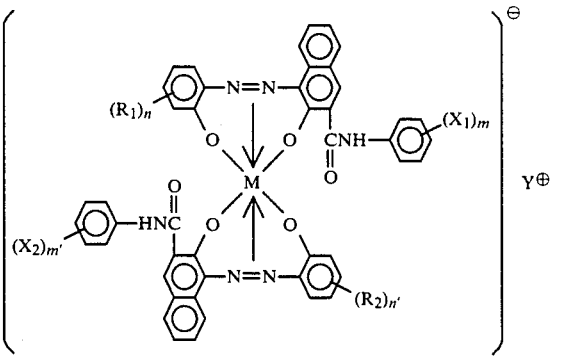

In the formulae (II), (III), (IV) and (V), M, $R_1$, $R_2$, $X_1$, $X_2$, n, n', m or m' are as defined above, and Y⊕ represents an alkali metal cation or a hydrogen cation. The metal complex compound of the formula (V) can be obtained with a high degree of yield.

(3) Then, the metal complex of the formula (V) is treated with ammonia, an aliphatic amine, an alicyclic amine or a heterocyclic amine by usual salt-forming treatment, whereby the metal complex of the formula (I) where Y⊕ is an ammonium ion, an aliphatic ammonium ion, an alicyclic ammonium ion or a heterocyclic ammonium ion, can readily be obtained.

In the preparation of the metal complexes of the formula (I), the aminophenol compound of the formula (II) may be selected from 5-nitro-2-aminophenol, 4,6-dinitro-2-aminophenol, 2-aminophenol, 4-chloro-2-aminophenol, 4,5-dichloro-2-aminophenol, 4-methyl-2-aminophenol, 4-butyl-2-aminophenol, 4-methyl-6-nitro-2-aminophenol, 6-methyl-B 4-nitro-2-aminophenol, 6-chloro-4-nitro-2-aminophenol, 4-acetyl-2-aminophenol, 4-sulfoamido-2-aminophenol, 4-sulfohexylamido-2-aminophenol, 4-acetyl-5-methyl-2-aminophenol, 4-formyl-2-aminophenol, 3,4,6-trichloro-2-aminophenol, 4,5-dimethyl-2-aminophenol and 5-methoxy-2-aminophenol. The $\beta$-naphthol compound of the formula (III) may be selected from 3-hydroxy-2-naphthanilide, 3-hydroxy-4'-chloro-2-naphthanilide, 3-hydroxy-2-naphtho-p-anisidide, 3-hydroxy-2-naphtho-o-anisidide, 3-hydroxy-2-naphtho-o-phenetidide, 3-hydroxy-2',5'-dimethoxy-2-naphthanilide, 3-hydroxy-2-naphtho-o-toluidide, 3-hydroxy-2-naphtho-2',4'-xylidide, 3-hydroxy-3'-nitro-2-naphthanilide, 3-hydroxy-4'-chloro-2-naphtho-o-toluidide, and 3-hydroxy-2',4'-dimethoxy-5'-chloro-2-naphthanilide.

The chromium-imparting compound may be selected from chromic acetate, chromic sulfate and chromium sodium salicylate; the cobalt-imparting compound may be selected from cobaltic chloride, cobaltous acetate and cobalt sodium salicylate; and the iron-imparting compound may be selected from ferric acetate, ferric chloride, ferric sulfate and ferric sodium salicylate.

As the amine compound which may be used for the salt-forming treatment, there may be mentioned those represented by the following general formulas (VI) and (VII):

$$R_4-\overset{\overset{R_3}{|}}{\underset{\underset{R_5}{|}}{N}} \qquad \text{(VI)}$$

where each of $R_3$, $R_4$ and $R_5$, which may be the same or different, is a hydrogen atom, an alkyl group, a halogen atom, a hydroxyl group, an alkoxy group, an amino group, an alkyl-substituted amino group, a phenyl group, a naphthyl group, an alkyl group substituted by a heterocyclic group or an alkenyl group, $R_3$ and $R_4$ may form a ring together with the nitrogen atom, or may form a ring together with the nitrogen atom and a further hetero atom; and $$R_7-\overset{\overset{R_6}{|}}{\underset{\underset{R_9}{|}}{\overset{\oplus}{N}}}-R_8\ A^{\ominus} \qquad \text{(VII)}$$

where each of $R_6$, $R_7$, $R_8$ and $R_9$, which may be the same or different, is an alkyl group, a halogen atom, a hydroxyl group, an alkoxy group, an amino group, an alkyl-substituted amino group, a phenyl group, a naphthyl group, an alkyl group substituted by a heterocyclic group or an alkenyl group, $R_3$ and $R_4$ may form a ring together with the nitrogen atom, or may form a ring together with the nitrogen atom and a further hetero atom, and $A^{\oplus}$ is a halogen atom or a residue of an onium compound, such as a sulfonic acid group.

Specifically, there may be mentioned the following compounds:

$NH_3$, $NH_4OH$, $H_2NC_4H_9$, $H_2NC_{12}H_{25}$, $H_2NC_{18}H_{37}$, $H_2N-CH(CH_3)_2$, $H_2N(CH_2)_4CH(C_2H_5)CH_2-CH_3$, $HN(C_4H_9)_2$, $(C_{12}H_{25})(H)N-C_2H_5$, $(C_3H_7)(H)N(CH_2)_4CH(C_2H_5)-CH_3$, $(CH_3)(H)N(C_{12}H_{25})_2$, $(C_2H_5)(C_4H_9)N-C_8H_{17}$, $H_2N(CH_2)_5CH(Cl)-CH_3$, $H_2NCH_2-C(H)(OH)-C_{16}H_{33}$, $(C_2H_4OH)_2N-CH_2-C(H)(OH)-C_{10}H_{21}$, $H_2N(CH_2)_3O(CH_2)_2-CH(C_2H_5)(CH_2)_3CH_3$, $HN(C_3H_6OC_{10}H_{21})_2$, $(C_{14}H_{29})(H)C(OH)-CH_2-N(H)(CH_2)_2NH_2$, $(C_{10}H_{21})(H)N(CH_2)_3N(CH_3)_2$ $(C_{12}H_{25})(CH_2-C_6H_5)N(CH_3)_2$,

-continued $(C_6H_{13})(H)N(CH_2)_2-C_6H_4-Cl$, $H_2N(CH_2)_3O(CH_2)_7CH_3$, $(C_{10}H_{21})(H)C(OH)-CH_2N(C_2H_5)_2-CH_2-C_{10}H_7$, $(C_8H_{17})(H)N(CH_2)_2-CH(CH_3)-C_4H_3N_2H$, $(C_3H_7)_2N-(CH_2)_4-CH=CH-CH_2CH_3$, $(C_4H_9)(H)N(CH_2)_2CH=CH-CH_3$, $(C_2H_5)_2N-CH_2-C_4H_3O$, $CH_2CH_2N(CH_3)CH_2CH_2$, $CH_2(CH_2CH_2)_2NH$, $O(CH_2CH_2)_2NH$, $O(CH_2CH_2)_2N-C_4H_9$, $HN(CH_2CH_2)_2NH$, $HN(CH_2CH_2)_2N-C_{10}H_{21}$, $N^{\oplus}(C_2H_5)_4.Cl^{\ominus}$, $(CH_3)_3N^{\oplus}-C_{12}H_{25}.Br^{\ominus}$, $(C_2H_5)_2(CH_3)N^{\oplus}(CH_2)_3C(H)(C_2H_5)-C_4H_9.CH_3SO_4^{\ominus}$, $(CH_3)_3N^{\oplus}-CH_2-C(H)(OH)-C_{14}H_{29}.I^{\ominus}$, $(C_{18}H_{37})(H)C(OH)-CH_2-N^{\oplus}(CH_3)_3.Cl^{\ominus}$, $(CH_3)_3N^{\oplus}CH_2-C(H)(OH)-C_{14}H_{29}.Br^{\ominus}$, $(C_{18}H_{37})(H)C(OH)-CH_2-N^{\oplus}(CH_3)_2-CH_2CH(OH)-C_2H_5.Cl^{\ominus}$, $(C_2H_5)_2(CH_3)N^{\oplus}-C_3H_6OC_8H_{17}.Cl^{\ominus}$, -continued

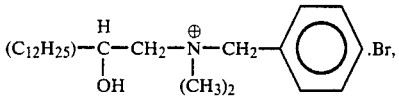

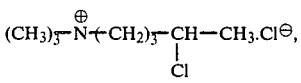

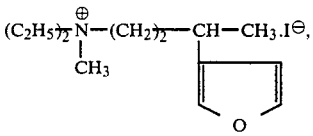

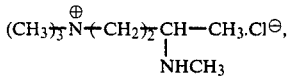

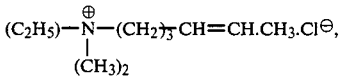

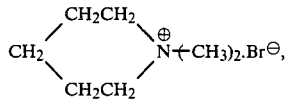

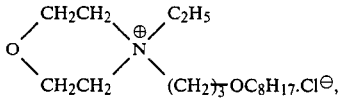

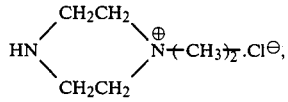

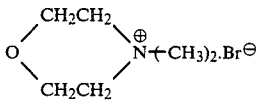

The crystals of the metal complexes of the formula (I) are extremely dividable. Therefore, the metal complexes of the formula (I), obtained from the above-mentioned preparation procedure, can be directly dispersed in the binder resin matrix, without preliminarily pulverizing the metal complexes. That is, during the dispersing procedure, the crystals of the metal complexes of the formula (I) are easily divided into extremely fine particles and the fine particles are uniformly dispersed in the binder resin matrix.

Also, the finely divided metal complexes of the formula (I) exhibit an extremely small bulk density which corresponds to 1/5 to 1/7 of that of conventional dyes. This extremely small bulk density is very effective for enhancing the compatibility of the charge-controlling and coloring agent of the present invention with the binder resin matrix.

Further, by virtue of the chemical structure with a counter ion, the metal complexes of the formula (I) have good compatibility with or solubility in various binder resins as the main component of the toner. Accordingly, when used as an additive for an electrophotographic toner, the metal complex of the formula (I) gives the toner an excellent antistatic stability in the continuous reproduction. It is particularly effective to provide stability even in a severe environment, e.g. in a high humidity condition. Further, it provides a superior coloring power, whereby a reproduced image will be remarkably sharp, and a reproduction with a superior color tone is obtainable.

It was confirmed that the result of the mutagenity test (Ames test) applied to the metal complexes of the formula (I) was negative.

The electrophotographic toner of the present invention can be prepared in the following manner.

A 2:1 type metal complex of the formula (I) is mixed with a binder resin in the form of a melt. The amount of the metal complex is, preferably, in the range of from 1 to 50% based on the weight of the binder resin. The mixture is cooled to solidify the binder resin. The solidified mixture is converted into fine toner particles by using a pulverizing machine, such as ball mill.

Otherwise, the toner of the preent invention can be prepared by the following method.

A binder resin is prepared by mixing the corresponding monomer or monomers with a polymerization initiator and a metal complex of the formula (I) and, then, the mixture is subjected to a polymerization procedure in which the mixture is suspended in water.

The most preferable preparation method for the toner of the present invention is the former mixing-solidifying-pulverizing method.

In the preparation of the toner, the mixture to be solidified or to be polymerized, may contain an additional coloring agent, for example, carbon black.

The toner of the present invention is used usually together with a carrier consisting of an iron or glass powder. When the mixture of the toner of the present invention and the carrier is applied to an electrophotographic procedure, friction occurs between the particles of the toner and the particles of the carrier. This friction causes the particles of the toner to be charged with an amount of electrostatic charge, which charge is sufficient for developing electrostatic latent images. Even if the developing operation is repeatedly carried out using the toner, the amount of the electrostatic charge on the toner particles can be maintained constant, and the distribution of the charge on the toner particles can be maintained uniform and constant.

Accordingly, when electrostatic latent images are developed by the toner of the present invention, the resultant visible images have a uniform color dark enough for practical reading and are very bright in comparison with those derived from conventional toners.

The specific examples presented below will serve to more fully elaborate how the present invention is practiced. However, it should be understood that the examples are only illustrative and in no way limit the present invention.

In the examples, the term "part" is always by weight.

EXAMPLE 1 and COMPARATIVE EXAMPLE 1

In Example 1, a mixture was prepared by agitating 14.4 parts of 4-chloro-2-aminophenol and 26 parts of a concentrated hydrochloric acid together with 400 parts of water. The mixture was cooled with ice to a temperature of 0° C. to 5° C. The cooled mixture was added with 6.9 parts of sodium nitrite. The admixture was agitated at the above-mentioned temperature for 2 hours to diazotize 4-chloro-2-aminophenol. The admixture containing the diazotized compound was added to a mixture of 26.3 parts of 3-hydroxy-2-naphthanilide, 300 parts of water and 10 parts of sodium hydroxide at a temperature of 0° C. to 5° C. to allow the diazotized compound of couple with 3-hydroxy-2-naphthanilide. A monoazo-compound having the following formula was isolated from the reaction mixture.

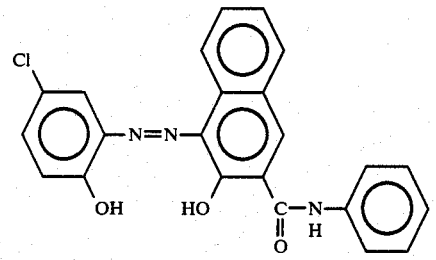

The monoazo compound in the form of a paste was dissolved in 150 parts of ethylene glycol and the resultant solution was mixed with 5 parts of sodium hydroxide and 17.4 parts by weight of chromium sodium salicylate. The mixture was agitated at a temperature of from 110° C. to 120° C. for 2 hours to metallize the monoazo compound with chromium. The mixture was cooled to a temperature of 50° C. and the cooled mixture was added with 10 parts of hydrochloric acid to make the mixture acid when inspected by using Congo Red. The reaction product was isolated from the mixture at room temperature by means of filtration, and finally, dried at a temperature of 50° C. to 60° C. under a reduced pressure.

A chromium complex in the form of a fine black powder was obtained in an amount of 49 parts.

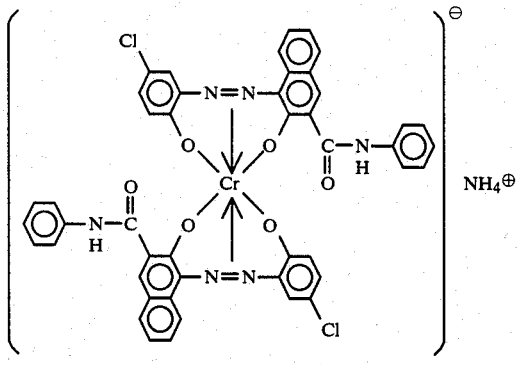

When the chromium complex was dissolved in dimethyl formamide, the solution exhibited a black color having a maximum absorption wave length of 577 nm.

An electrophotographic toner was prepared by using the chromium complex in the following manner.

A uniform mixture of 100 parts of a binder resin consisting of a styrene copolymer, 6 parts of carbon black and 1 part of the chromium complex was melted at a temperature of 150° C., cooled to solidify the melt and, then, pulverized by using a ball mill. A black toner which is capable of being charged with a negative charge, was obtained. The black toner was mixed with a carrier consisting of fine iron particles having a diameter of 100 to 150 microns, in a weight ratio of 5:100, to prepare an electrophotographic developing agent.

The above-mentioned developing agent was subjected to an electrophotographic procedure as follows.

A predetermined pattern of positive electrostatic latent images was formed on a photosensitive selenium plate surface electrified by means of a corona discharge under a voltage of +5000 V. The latent images were developed with the developing agent by means of a magnetic brush development to form visible positive images. The positive images were transferred onto a piece of paper by means of a corona discharge under a voltage of +5000 V. The transferred images were heat-fixed on the paper by heating it to a temperature of 180° C. The resultant fixed visible images were clear and had no fog.

The above-mentioned electrophotographic procedures were continuously carried out 50,000 times. It was found that no change occurred in the electrification property of the toner. Also, it was found that the average quantity of electricity on the toner was −20 μc/g, which was determined in accordance with the Blow-Off method, and the distribution of the electric charge on the toner was approximately even and was in the range of from −19.5 μc/g to −21.0 μc/g.

As a Comparative Example, an electrophotographic operation was conducted in the same manner as in Example 1 except that the developing agent used did not contain the metal complex of Example 1. The images thereby obtained were unclear and obscure due to inadequate electrification of the developing agent or due to a substantial change in the electrification during the continuous photocopying operation. The change in the electrification of the developing agent during the continuous photocopying operation for 5,000 reproductions (5,000 times) was from −10 to −30 μc/g.

EXAMPLE 2

The same procedures as those described in Example 1 were carried out, except that 3-hydroxy-2-naphthanilide was replaced by 29.3 parts of 3-hydroxy-2-naphto-o-anisidide, to produce a chromium complex of the formula:

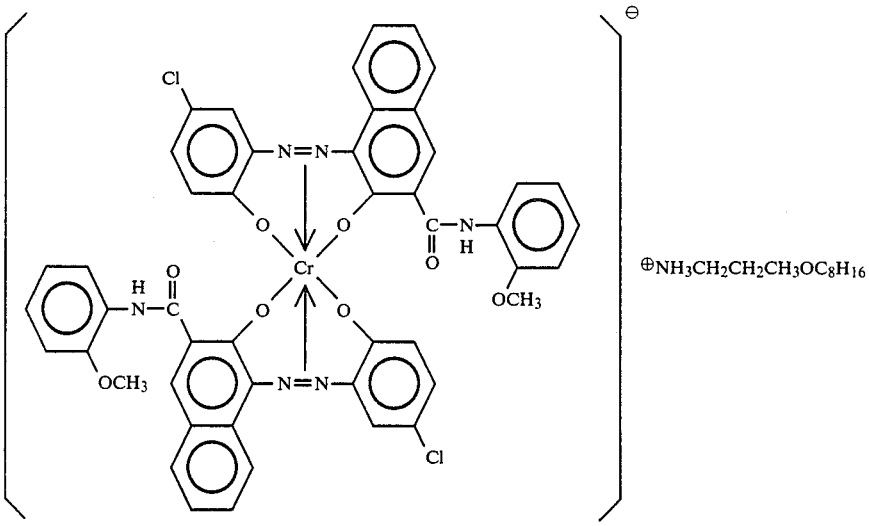

$\oplus NH_3CH_2CH_2CH_3OC_8H_{16}$

The chromium complex was in the form of fine black particles.

The developing agent containing the above-mentioned chromium complex was effective for forming clear visible images without soiling the visible images on the substrate. Also, it was confirmed that, although the developing procedures were repeated 50,000 times, no change in the electrification property of the toner occurred, and, therefore, the quality of the visible images was constant.

EXAMPLES 3 to 32

In each of the Examples 3 to 9, the same procedures as those described in Example 1 were carried out, except that the monoazo compound was of the formula:

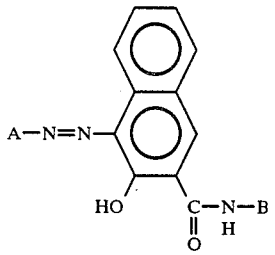

wherein, A and B represent radicals identified in Table 1; the monoazo compound was dissolved in the solvent indicated in Table 1 and, then, metallized with the metal indicated in Table 1.

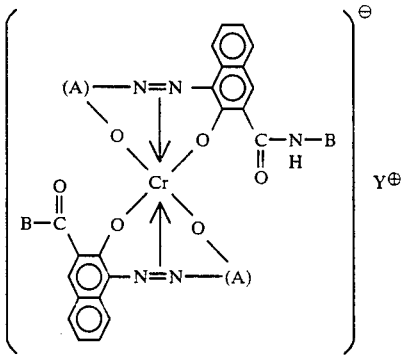

M represents the type of metal indicated in Table 1. $Y\oplus$ cation is also identified in Table 1.

The resultant metal complex had the maximum absorption wave length and the color indicated in Table 1.

The developing agent containing the above-mentioned metal complex was effective for forming clear visible images on a paper substrate without soiling around the images. Also, it was confirmed that, although the developing procedures were repeated 50,000 times, no change in electrification property of the toner coccurred and the quality of the resultant visible images was constant.

TABLE 1

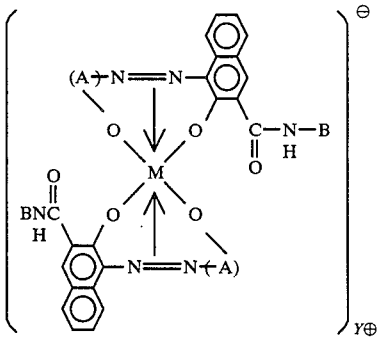

TABLE 1-continued

| Example No. | Type of 1:2 metal complex compound | Type of metal | Solvent used in metallization procedure | Type of $Y^{\oplus}$ cation | Maximum absorption wave length (nm) | Appearance |
|---|---|---|---|---|---|---|
| 3 | A: 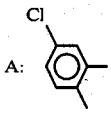 B: 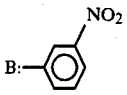 | Cr | Water | $H_3NC_3H_6OC_8H_{17}$ | 578 | Fine black particles |
| 4 | A: 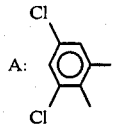 B: 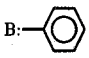 | Cr | Ethylene glycol | $NH_4$ | 583 | Fine black particles |
| 5 | A: 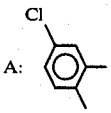 B: 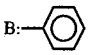 | Cr | Diethylene glycol | $H_3N(C_4H_9)$ | 577 | Fine black particles |
| 6 | A: 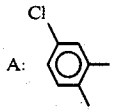 B: 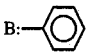 | Cr | Dimethylformamide | $H_3N(C_4H_9)$ | 577 | Fine black particles |
| 7 | A: 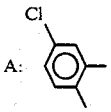 B: 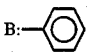 | Cr | Formamide | $H_3NC_3H_6OC_8H_{17}$ | 577 | Fine black particles |
| 8 | A: 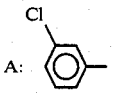 B: 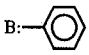 | Fe | Ethylene glycol | $NH_4$ | 540 | Fine black particles |
| 9 | A: 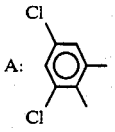 B: 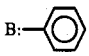 | Co | Ethylene glycol | $H_3NC_8H_{17}$ | 572 | Fine black particles |
| 10 | A: 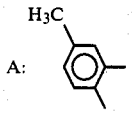 B: 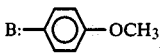 | Cr | Water and n-butyl alcohol (1:3) | $H_3N(CH_2)_5CH(Cl)-CH_3$ | 560 | Fine black particles |

TABLE 1-continued

| | | | | | | |
|---|---|---|---|---|---|---|
| 11 | A: 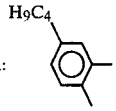 B: 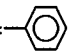 | Cr | Dimethylformamide | 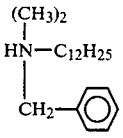 | 558 | Fine black particles |
| 12 | A: 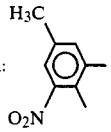 B: 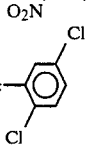 | Cr | Methyl isopropyl ketone | 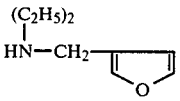 | 571 | Fine black particles |
| 13 | A: 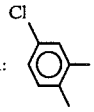 B: 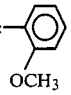 | Cr | n-butyl alcohol | $NH_4$ | 576 | Fine black particles |
| 14 | A: 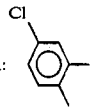 B: 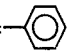 | Co | n-Butyl alcohol | 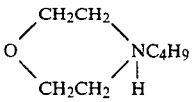 | 572 | Fine black particles |
| 15 | A: 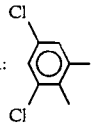 B: 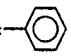 | Co | Methyl ethyl ketone | 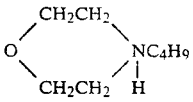 | 683 | Fine black particles |
| 16 | A: 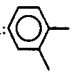 B: 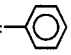 | Cr | Methyl ethyl ketone | $NH_4$ | 550 | Fine black particles |
| 17 | A: 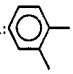 B: 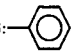 | Co | n-Butyl alcohol | $H_3NC_{12}H_{25}$ | 545 | Fine black particles |
| 18 | A: 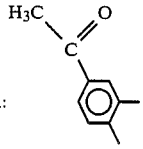 B: 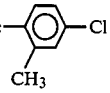 | Cr | Water | 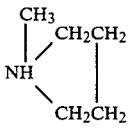 | 570 | Fine black particles |

TABLE 1-continued

| | | | | | | |
|---|---|---|---|---|---|---|
| 19 | A: $H_2NO_2S$ 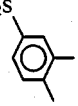 B: 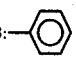 | Cr | Diethylene glycol | 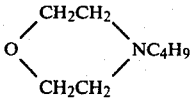 | 540 | Fine black particles |
| 20 | A: 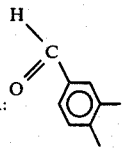 B: 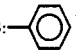 | Co | Formamide | $(C_3H_7)_2N(CH_2)_4CH=CH_2CH_3$ | 565 | Fine black particles |
| 21 | A: 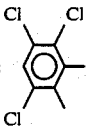 B: 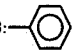 | Cr | n-Butyl alcohol | $H_3NCH_2-C(OH)-C_{16}H_{33}$ | 588 | Fine black particles |
| 22 | A: 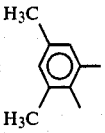 B: 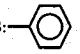 | Co | n-Butyl alcohol | $H_3NCH_2-C(OH)-C_{16}H_{33}$ | 567 | Fine black particles |
| 23 | A: $H_3CO$ 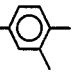 B: 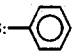 | Cr | Ethylene glycol | $H_2N(C_4H_9)_2$ | 562 | Fine black particles |
| 24 | A: $O_2H$ 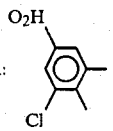 B: 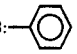 | Cr | Iso-butyl alcohol | $H_2N(C_4H_9)_2$ | 555 | Fine black particles |
| 25 | A: 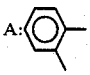 B: 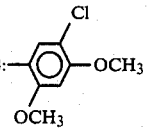 | Cr | Water | $NH_4$ | 559 | Fine black particles |
| 26 | A: $H_3C$ 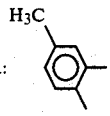 B: 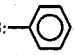 | Fe | Water and ethylene glycol (1:2) | $(C_{12}H_{25})N(CH_5)_2$ H | 543 | Fine black particles |

TABLE 1-continued

| | | | | | | |
|---|---|---|---|---|---|---|
| 27 | A: 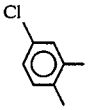 B: 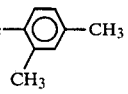 | Co | Dimethylformamide | $H_3N(CH_2)_5CH(Cl)-CH_3$ | 579 | Fine black particles |
| 28 | A: 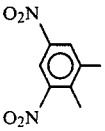 B: 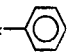 | Fe | Water | $NH_4$ | 540 | Fine black particles |
| 29 | A: 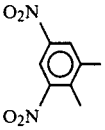 B: 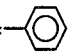 | Fe | Diethylene glycol | $H_2N-CH(CH_3)-CH_3$ | 540 | Fine black particles |
| 30 | A: 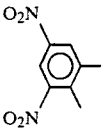 B: 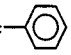 | Fe | Diethylene glycol | $(C_{12}H_{25})N(CH_3)_2-CH_2-$ 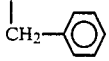 | 540 | Fine black particles |
| 31 | A: 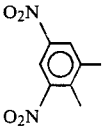 B: 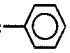 | Fe | Diethylene glycol | $H_3NC_3H_6OC_8H_{17}$ | 540 | Fine black particles |
| 32 | A: 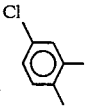 B: 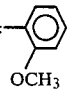 | Fe | Water | $H_3NC_3H_6OC_8H_{17}$ | 538 | Fine black particles |

EXAMPLE 33

Into 150 parts of ethylene glycol, 20.9 parts of the monoazo compound of the formula:

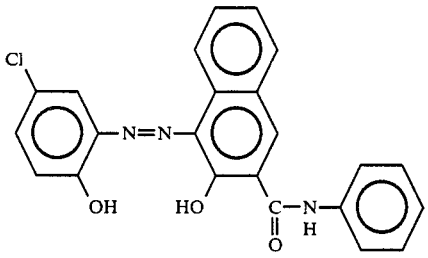

prepared in the same manner as in Examples 1 to 32, was dissolved. Then, 10 parts of concentrated sulfuric acid and 4.6 parts of a 40% chromium sulfate aqueous solution was added thereto, and the mixture was stirred at a temperature of from 95° to 105° C. for 3 hours to metallize the monoazo compound with chromium.

Then, 22.4 parts of the monoazo compound of the formula:

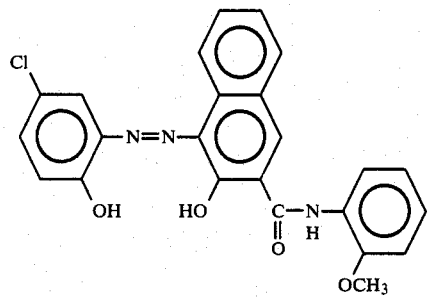

prepared in the same manner as above, and 10 parts of sodium hydroxide were added thereto, and the mixture was stirred at a temperature of from 95° to 100° C. for 2 hours. The reaction mixture was cooled to room temperature, and 5 parts of hydrochloric acid was added thereto to make the mixture acidic as inspected by using Congo Red. The reaction product was isolated from the reaction mixture at room temperature by means of filtration, and dried at a temperature of from 50° to 60° C. under a reduced pressure, whereby 45 parts of a chromium complex of the formula:

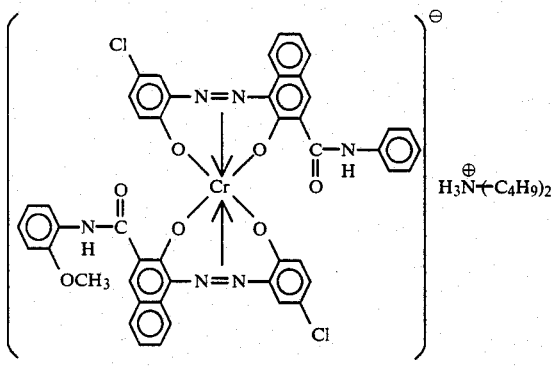

having a black color was obtained.

The chromium complex was in the form of fine black particles. A solution of the chromium complex in dimethylformamide exhibited a maximum absorption wave length of 578 nm.

The developing agent containing the above-mentioned chromium complex was useful for producing clear visible images on a substrate consisting of paper without soil being formed around the images. Also, the developing agent count be used for repeating the developing procedures 50,000 times without changing the electrification property of the toner. The quality of the developed visible images was constant during the repeated developing procedures.

EXAMPLES 34 to 48

In each of the Examples 34 to 48, the same procedures as those described in Example 33 were carried out, except that the monoazo compound was of the formula:

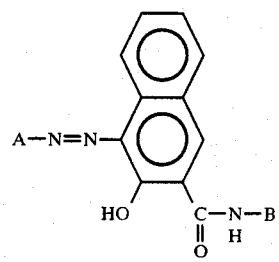

and

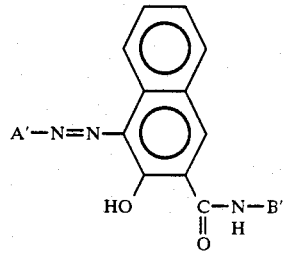

wherein, A, A', B and B' represent the radicals indicated in Table 2; the monoazo compound was dissolved in the solvent indicated in Table 2 and, then, metallized with the metal indicated in Table 2.

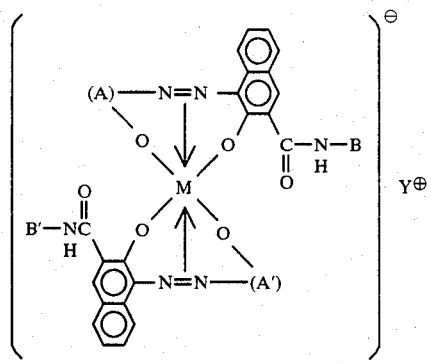

M represents the type of metal indicated in Table 2. Y⊕ cation is also identified in Table 2.

The resultant metal complex had the maximum absorption wave length and the color indicated in Table 2.

The developing agent containing the above-mentioned metal complex could form clear visible images on a paper substrate without soil being formed around the images. Also, it was confirmed that, although the developing procedures were repeated 50,000 times, the electrification property of the toner was not changed and the quality of the resultant visible images was constant.

TABLE 2

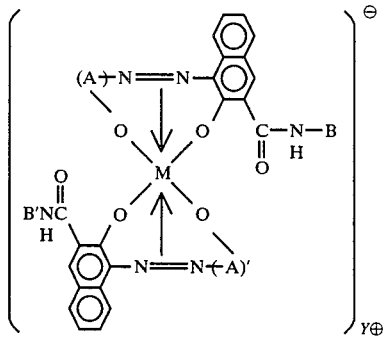

| Example No. | Type of 1:2 metal complex compound | Type of metal | Solvent used in metallization procedure | Type of $Y^{\oplus}$ cation | Maximum absorption wave length (nm) | Appearance |
|---|---|---|---|---|---|---|
| 34 | A: 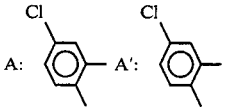 A':  B: 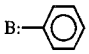 B': 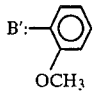 | Co | Diethylene glycol | $H_3NC_3H_6OC_4H_9$ | 577 | Fine black particles |
| 35 | A: 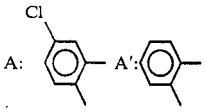 A':  B: 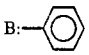 B': 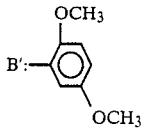 | Cr | Diethylene glycol | $H_3NC_3H_6OC_4H_9$ | 570 | Fine black particles |
| 36 | A: 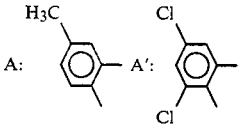 A':  B: 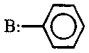 B': 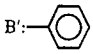 | Cr | Ethylene glycol | $NH_4$ | 568 | Fine black particles |
| 37 | A: 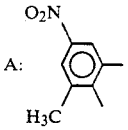 A': 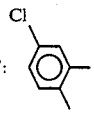 B: 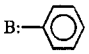 B': 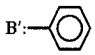 | Fe | Diethylene glycol and water (1:1) | 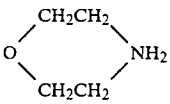 | 578 | Fine black particles |
| 38 | A: 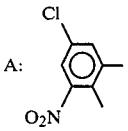 A': 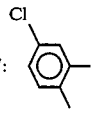 B: 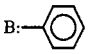 B': 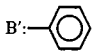 | Fe | Diethylene glycol and water (1:1) | 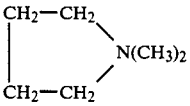 | 579 | Fine black particles |

TABLE 2-continued
| | | | | | | |
|---|---|---|---|---|---|---|
| 39 | 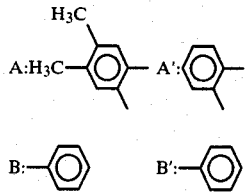 | Cr | Ethylene glycol | $H_3NC_4H_9$ | 560 | Fine black particles |
| 40 | 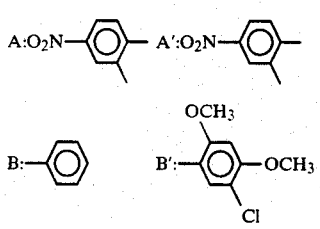 | Cr | Ethylene glycol | $H_3NC_4H_9$ | 585 | Fine black particles |
| 41 | 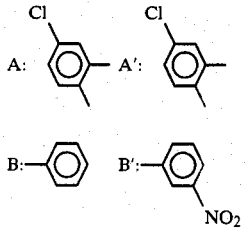 | Co | Diethylene glycol | 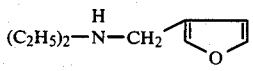 | 577 | Fine black particles |
| 42 | 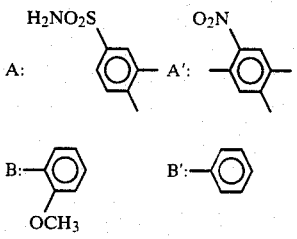 | Fe | n-Butyl alcohol | $H_3NC_3H_6OC_8H_{17}$ | 573 | Fine black particles |
| 43 | 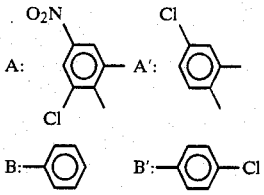 | Cr | Water and ethylene glycol (1:2) | $NH_4$ | 575 | Fine black particles |
| 44 | 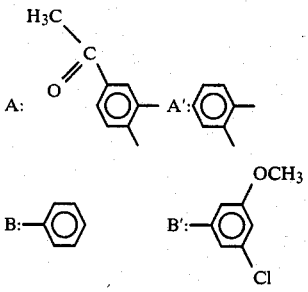 | Cr | Ethylene glycol | $NH_4$ | 557 | Fine black particles |

TABLE 2-continued

| | | | | | | |
|---|---|---|---|---|---|---|
| 45 | 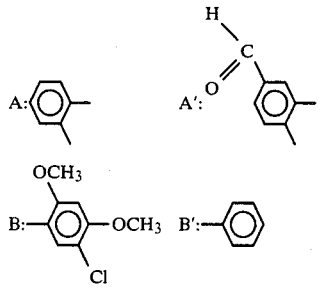 | Cr | Ethylene glycol | $NH_4$ | 565 | Fine black particles |
| 46 | 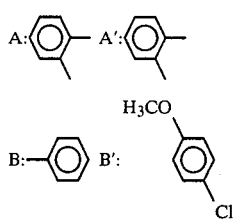 | Cr | Ethylene glycol | 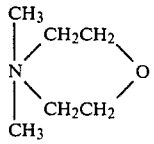 | 538 | Fine black particles |
| 47 | 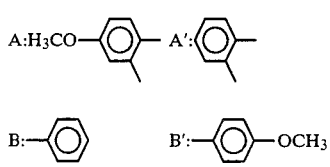 | Cr | Ethylene glycol | 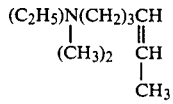 | 541 | Fine black particles |
| 48 | 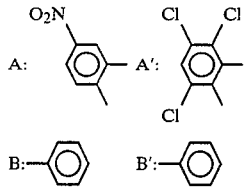 | Cr | Ethylene glycol | 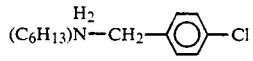 | 585 | Fine black particles |

What is claimed is:

1. An electrophotographic toner capable of being electrified nagatively comprising:

(a) a binder resin; and (b) a charge-controlling and coloring agent comprising at least one 2:1 type metal complex of the formula (I):

(I)

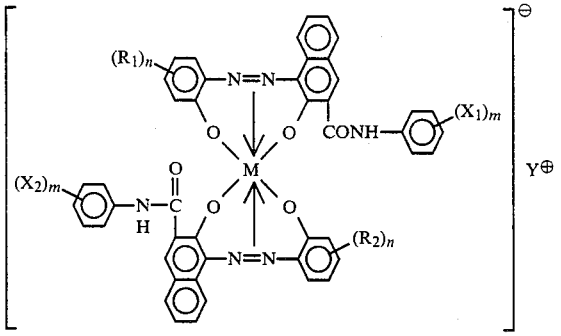

where each of $X_1$ and $X_2$, which may be the same or different, is a hydrogen atom, a $C_1$–$C_5$ alkyl group, a $C_1$–$C_5$ alkoxy group, a nitro group or a halogen atom, each of m and m' is an integer of 1 to 3, each of $R_1$ and $R_2$, which may be the same or different, is a hydrogen atom, a $C_1$–$C_5$ alkyl group, a $C_1$–$C_5$ alkoxy group, a halogen atom, a nitro group, a sulfonamide group, a methylsulfonyl group, an ethylsulfonyl group, an acetyl amino group or a benzoyl amino group, each of n and n' is an integer of 1 to 3, $Y^{\oplus}$ is an ammonium ion, an aliphatic ammonium ion, an alicyclic ammonium ion or a heterocyclic ammonium ion, and M is an iron atom, provided that $R_1$ and $R_2$ are not simultaneously nitro groups.

2. The electrophotographic toner according to claim 1, wherein $Y^{\oplus}$ is a cation selected from the group consisting of $NH_4$, $NH_3CH_2CH_2CH_3OC_8H_{16}$, $H_3NC_3H_6OC_8H_{17}$, $H_3N-(C_4H_9)$,

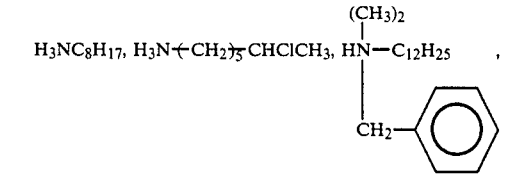

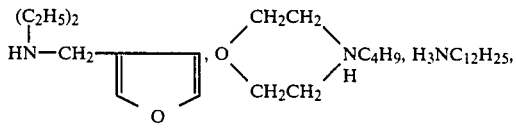

-continued

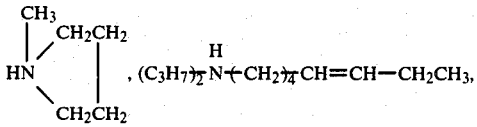

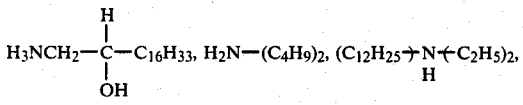

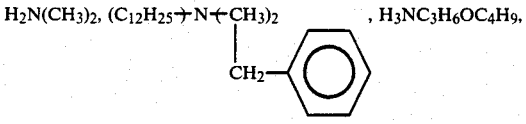

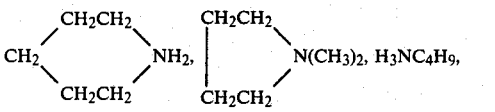

-continued

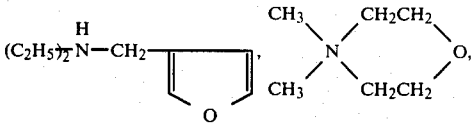

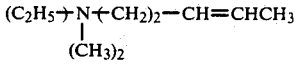

and

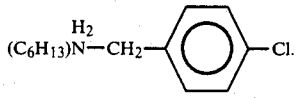

3. The electrophotographic toner according to claim 1, wherein each of $X_1$ and $X_2$ is —H, —$NO_2$, —$OCH_3$, —Cl or —$CH_3$, and ech of $R_1$ and $R_2$ is —H, —Cl, —CH3, —$C_4H_9$, —$NO_2$, —$COCH_3$, —$SO_2NH_2$, —CHO or —$OCH_3$.

4. The electrophotographic toner according to claim 1, wherein the binder resin is a homopolymer or copolymer of styrene, polyvinyl chloride, polypropylene, a silicone resin, polyvinyl butyral, rosin, modified rosin, a terpene resin, a phenolic resin, a xylene resin, an aliphatic or alicyclic hydrocarbon, an aromatic series petroleum resin, a chlorinated paraffin, or paraffin wax.

* * * * *